US007608169B2

(12) United States Patent
Backstrom et al.

(10) Patent No.: US 7,608,169 B2
(45) Date of Patent: Oct. 27, 2009

(54) APPARATUS AND METHOD FOR BREAK RECOVERY IN A PAPER MACHINE OR OTHER SYSTEM

(75) Inventors: Johan U. Backstrom, North Vancouver (CA); Gregory E. Stewart, North Vancouver (CA)

(73) Assignee: Honeywell Asca Inc., Ontario (CA)

( * ) Notice: Subject to any disclaimer, the term of this patent is extended or adjusted under 35 U.S.C. 154(b) by 349 days.

(21) Appl. No.: 11/501,576

(22) Filed: Aug. 9, 2006

(65) Prior Publication Data

US 2008/0039968 A1 Feb. 14, 2008

(51) Int. Cl.
*D21F 11/00* (2006.01)

(52) U.S. Cl. ..... 162/198; 162/252; 162/263; 700/129; 700/75

(58) Field of Classification Search ..... 162/198, 162/252; 700/129, 75
See application file for complete search history.

(56) References Cited

U.S. PATENT DOCUMENTS 5,583,782 A 12/1996 Heaven et al.
5,743,177 A 4/1998 Wostbrock

FOREIGN PATENT DOCUMENTS

EP 0390686 A2 10/1990

*Primary Examiner*—Mark Halpern
(74) *Attorney, Agent, or Firm*—Munck Carter, P.C.

(57) ABSTRACT

A method includes determining one or more setpoint changes for one or more actuators in a process control system. Determining the one or more setpoint changes includes making larger or more frequent setpoint changes when operating in a first mode and making smaller or less frequent setpoint changes when operating in a second mode. The method also includes outputting the one or more setpoint changes to the one or more actuators. The method could further include entering the first mode after a paper sheet has broken and been rethreaded through a paper machine. The method could also include entering the second mode (i) after a specified amount of time has elapsed since entering the first mode or (ii) after the first mode has been entered and a caliper profile of the paper sheet is within a specified threshold of a desired caliper profile.

20 Claims, 4 Drawing Sheets

APPARATUS AND METHOD FOR BREAK RECOVERY IN A PAPER MACHINE OR OTHER SYSTEM

TECHNICAL FIELD

This disclosure relates generally to control systems and more specifically to an apparatus and method for caliper profile break recovery in a paper machine.

BACKGROUND

Various systems are available and used to manufacture sheets of paper and other paper products. The sheets of paper being manufactured often have multiple characteristics that are monitored and controlled during the manufacturing process, such as dry weight, moisture, and caliper (thickness). The control of these or other sheet properties in a sheet-making machine is typically concerned with keeping the sheet properties as close as possible to target or desired values.

During the manufacturing process, it is common for a paper sheet being produced to tear or break. When this occurs, the paper sheet is typically rethreaded through the sheet-making machine, and operation of the sheet-making machine resumes. However, for a period of time after the rethreading, the paper sheet produced by the sheet-making machine is typically not usable or saleable. This is because the break in the paper sheet often disturbs or interferes with the control of the sheet-making machine, so the paper sheet produced after the break typically has sheet properties that are not near the target or desired values. As a result, the sheet-making machine often needs to be operated until the disturbances caused by the break are eliminated and the sheet properties return to or near the target or desired values. This typical results in a loss of both time and materials.

As a particular example, the caliper or thickness of a paper sheet is often controlled by passing the paper sheet between counter-rotating rolls. The space between two rolls is often referred to as a "nip." The pressure applied by the rolls to the paper sheet is typically controlled by varying the temperature of the rolls. For example, heating the rolls typically causes the diameter of the rolls to expand, decreasing the size of the nip and increasing the pressure applied to the paper sheet. This compresses the paper sheet and reduces its thickness. By controlling the temperature of the rolls, the pressure applied by the rolls to the paper sheet may be controlled, thereby facilitating control over the paper sheet's thickness. However, if a break in the paper sheet occurs, the temperature of the rolls may change significantly. When the paper sheet is rethreaded in the sheet-making machine, the thickness of the paper sheet may be far from the target or desired caliper value.

SUMMARY

This disclosure provides an apparatus and method for caliper profile break recovery in a paper machine.

In a first embodiment, a method includes determining one or more setpoint changes for one or more actuators in a process control system. Determining the one or more setpoint changes includes making larger or more frequent setpoint changes when operating in a first mode and making smaller or less frequent setpoint changes when operating in a second mode. The method also includes outputting the one or more setpoint changes to the one or more actuators.

In particular embodiments, the method further includes entering the first mode after a paper sheet has broken and been rethreaded through a paper machine. In other particular embodiments, the method further includes entering the second mode (i) after a specified amount of time has elapsed since entering the first mode or (ii) after the first mode has been entered and a caliper profile of the paper sheet is within a specified threshold of a desired caliper profile.

In a second embodiment, an apparatus includes a control law unit operable to determine one or more setpoint changes for one or more actuators in a process control system. The control law unit is operable to determine the one or more setpoint changes by making larger or more frequent setpoint changes when operating in a first mode and by making smaller or less frequent setpoint changes when operating in a second mode. The apparatus also includes an interface operable to output the one or more setpoint changes to the one or more actuators.

In a third embodiment, a computer program is embodied on a computer readable medium and is operable to be executed by a processor. The computer program includes computer readable program code for determining one or more setpoint changes for one or more actuators in a process control system. The computer readable program code for determining the one or more setpoint changes includes computer readable program code for making larger or more frequent setpoint changes when operating in a first mode and computer readable program code for making smaller or less frequent setpoint changes when operating in a second mode. The computer program also includes computer readable program code for outputting the one or more setpoint changes to the one or more actuators.

In a fourth embodiment, a system includes a paper machine operable to produce a paper sheet. The paper machine includes a plurality of actuators. The system also includes a controller operable to determine one or more setpoint changes for one or more of the actuators. The controller is operable to determine the one or more setpoint changes by making larger or more frequent setpoint changes when operating in a first mode and by making smaller or less frequent setpoint changes when operating in a second mode.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1:
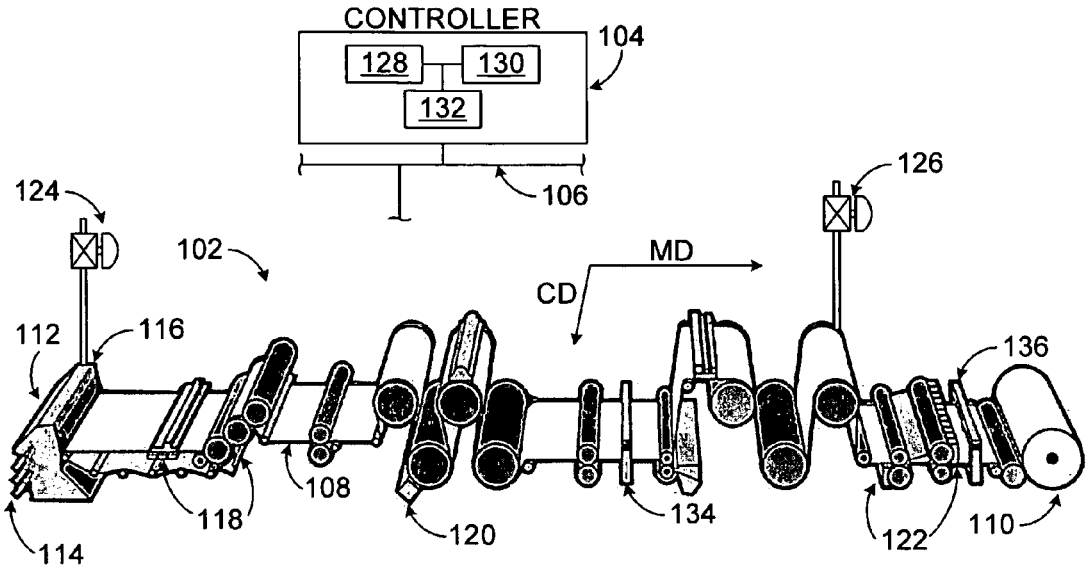
FIG. 1 illustrates an example process control system in accordance with this disclosure.

FIG. 1 illustrates an example process control system 100 in accordance with this disclosure. The embodiment of the process control system 100 shown in FIG. 1 is for illustration only. Other embodiments of the process control system 100 may be used without departing from the scope of this disclosure.

In this example embodiment, the process control system 100 includes a paper machine 102, a controller 104, and a network 106. The paper machine 102 includes various components used to produce a paper product. In this example, the various components may be used to produce a paper sheet 108 collected at a reel 110.

As shown in FIG. 1, the paper machine 102 includes a headbox 112, which distributes a pulp suspension uniformly across the machine onto a continuous moving wire screen or mesh. The pulp suspension entering the headbox 112 may contain, for example, 0.2-3% wood fibers and/or other solids, with the remainder of the suspension being water. The headbox 112 may include an array of dilution actuators 114, which distributes dilution water into the pulp suspension across the sheet. The dilution water may be used to help ensure that the resulting paper sheet 108 has a more uniform cross direction basis weight across the sheet. The headbox 112 may also include an array of slice lip actuators 116, which controls a slice opening across the machine from which the pulp suspension exits the headbox 112 onto the moving wire screen or mesh. The array of slice lip actuators 116 may also be used to control the cross direction basis weight of the paper sheet 108.

Arrays of steam actuators 118 produce hot steam that penetrates the paper sheet 108 and releases the latent heat of the steam into the paper sheet 108, thereby increasing the temperature of the paper sheet 108. The increase in temperature may allow for easier removal of water from the paper sheet 108. An array of rewet shower actuators 120 adds small droplets of water (which may be air atomized) onto the surface of the paper sheet 108. The array of rewet shower actuators 120 may be used to control the cross direction moisture profile of the paper sheet 108, reduce or prevent over-drying of the paper sheet 108, or correct any dry streaks in the paper sheet 108.

The paper sheet 108 is then passed through several nips of counter-rotating rolls. Arrays of induction heating actuators 122 heat the shell surfaces of iron rolls across the machine. As the roll surfaces locally heat up, the roll diameters are locally expanded and hence increase nip pressure, which in turn locally compresses the paper sheet 108. The arrays of induction heating actuators 122 may therefore be used to control the cross direction caliper (thickness) profile of the paper sheet 108.

Two additional actuators 124-126 are shown in FIG. 1. A thick stock flow actuator 124 controls the consistency of the incoming pulp received at the headbox 112. A steam flow actuator 126 controls the amount of heat transferred to the paper sheet 108 from drying cylinders. The actuators 124-126 could, for example, represent valves controlling the flow of pulp and steam, respectively. These actuators may be used for controlling the machine direction dry weight and moisture of the paper sheet 108.

This represents a brief description of one type of paper machine 102 that may be used to produce a paper product. Additional details regarding this type of paper machine 102 are well-known in the art and are not needed for an understanding of this disclosure. Also, this represents one specific type of paper machine 102 that may be used in the process control system 100. Other machines or devices could be used that include any other or additional components for producing a paper product. Further, additional components could be used to further process the paper sheet 108, such as a supercalender for improving the paper sheet's thickness, smoothness, and gloss. In addition, this disclosure is not limited to use with systems for producing paper products and could be used with systems that produce other items or materials, such as plastic, textiles, metal foil, or sheets, or other or additional materials.

Figure 2:
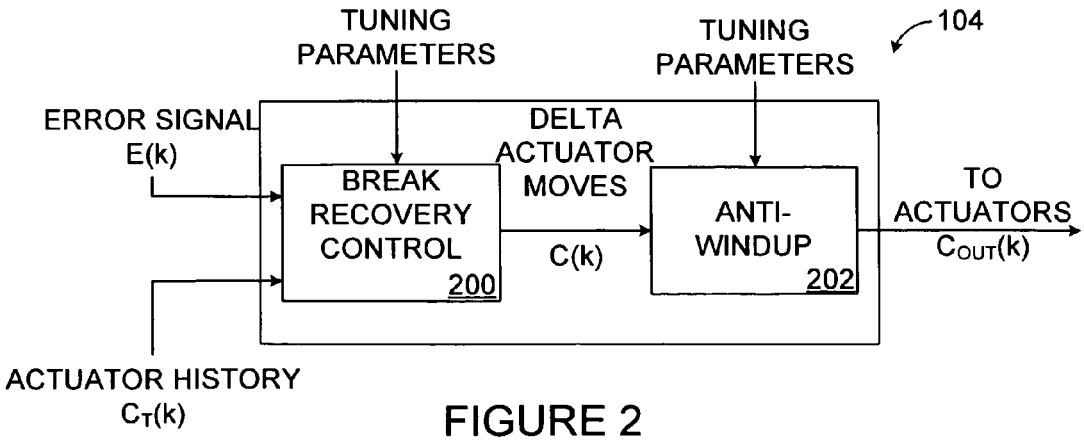
FIG. 2 illustrates an example controller of a process control system in accordance with this disclosure.

The controller 104 is capable of controlling the operation of the paper machine 102. For example, the controller 104 may control the operation of various actuators in the paper machine 102. The controller 104 includes any hardware, software, firmware, or combination thereof for controlling the operation of at least part of the paper machine 102. The controller 104 could, for example, include one or more processors 128, one or more memories 130 capable of storing data and instructions used by the processors 128, and one or more interfaces 132 facilitating communication with external components. One example embodiment of the controller 104 is shown in FIG. 2, which is described below.

In some embodiments, the paper machine 102 also includes two scanners 134-136, each of which may include a set of sensors. The scanners 134-136 are capable of scanning the paper sheet 108 and measuring one or more characteristics of the paper sheet 108. For example, the scanners 134-136 could carry sensors for measuring the weight, moisture, caliper (thickness), gloss, smoothness, or any other or additional characteristics of the paper sheet 108. Each of the scanners 134-136 includes any suitable structure or structures for measuring or detecting one or more characteristics of the paper sheet 108, such as sets or arrays of sensors. Each of the scanners 134-136 could also be located in any suitable location in the system 100. A scanning set of sensors represents one particular embodiment for measuring sheet properties. Other embodiments could include using stationary sets or arrays of sensors. Each of these embodiments may produce one or more arrays of measurements representing a cross direction profile. The cross direction (CD) in the system 100 is typically perpendicular to the machine direction (MD) in the system 100.

The network 106 is coupled to the controller 104 and the paper machine 102. The network 106 facilitates the transport of signals between components of the system 100. For example, the network 106 may transport control signals from the controller 104 to actuators in the paper machine 102. The network 106 may also transport measurement data from the scanners 134-136 to the controller 104. The network 106 may represent any suitable type of network or networks for transporting signals between various components of the process control system 100, such as a communication network or a network of pneumatic control signal tubes.

In one aspect of operation, the paper sheet 108 could tear or break during operation of the paper machine 102, requiring the paper sheet 108 to be rethreaded through the paper machine 102. This interruption in the operation of the paper machine 102 may cause disturbances or interference with the control of the paper machine 102 by the controller 104. For example, the caliper of the paper sheet 108 produced immediately after operation of the paper machine 102 resumes is often far from a desired or target caliper value. This typically requires that the paper machine 102 operate for a period of time to allow the caliper of the paper sheet 108 to be corrected. The paper sheet 108 produced during this time is often not usable or saleable.

According to this disclosure, the controller 104 implements a break recovery control mechanism supporting at least two different control strategies. One strategy may be used during normal or steady-state operation of the paper machine 102, where caliper control for the paper machine 102 is generally more conservative. This may mean that smaller or less frequent setpoint changes are made to the induction heating actuators 122. Another strategy may be used when recovering from a break in the paper sheet 108, where caliper control for the paper machine 102 is more aggressive. This may mean that larger or more frequent setpoint changes are made to the induction heating actuators 122. The more aggressive strategy may help the controller 104 to more quickly eliminate the effects of a sheet break on the caliper profile of the paper sheet 108. The more conservative strategy may help the controller 104 to reduce or prevent excessive control action, or excessive adjustments to the paper machine 102 with little or no benefit. A switching strategy can be used to switch between the control strategies with little or no excessive transient effects caused by the switching. In this way, the controller 104 may facilitate faster recovery from a break in the paper sheet 108, such as faster recovery of the cross direction caliper profile of the paper sheet 108.

The controller 104 could also provide an anti-windup mechanism and a fastback error clamping mechanism. The anti-windup mechanism may help to prevent the controller 104 from adjusting a profile value (such as the caliper of the paper sheet 108) in a way that would cause the profile value to overshoot its intended target. In some embodiments, a user is given the option of selecting the level of anti-windup protection provided by the controller 104. The tunable anti-windup protection can also be used to help to maintain actuator positions or "setpoints" at the actuators' maximum or minimum positions for a longer period of time, which may help to accelerate break recovery.

Although FIG. 1 illustrates one example of a process control system 100, various changes may be made to FIG. 1. For example, other systems could be used to produce paper products or other products. Also, the process control system 100 could include any number of paper machines 102, controllers 104, and networks 106, and the paper machine 102 could include any number of actuators and sensors or scanners. In addition, FIG. 1 illustrates one operational environment in which the break recovery control mechanism and the anti-windup mechanism could be used. Each of these mechanisms could be used in any other suitable system.

FIG. 2 illustrates an example controller 104 of a process control system in accordance with this disclosure. The controller 104 shown in FIG. 2 is for illustration only. Other embodiments of the controller 104 could be used without departing from the scope of this disclosure. Also, for ease of explanation, the controller 104 is described as operating in the process control system 100 of FIG. 1. The controller 104 could be used in any other device and in any other system.

As shown in FIG. 2, a break recovery control module 200 generally receives various inputs and calculates setpoint changes or "deltas" for one or more actuators. The inputs may include error profiles, which are referred to as an error signal E(k) in FIG. 2. The inputs may also include the historical actuator setpoint changes, which are referred to as an actuator history signal $C_T(k)$ in FIG. 2. In addition, the inputs may include one or more tuning parameters, which could include a gain, time constant, and mode. The mode (such as a value or zero or one) could indicate whether the break recovery control module 200 should operate in fast mode or slow mode.

The break recovery control module 200 produces output values C(k), which represent desired changes to the setpoints of one or more actuators. These output values are processed by an anti-windup unit 202. The anti-windup unit 202 may receive various inputs, such as a tuning parameter identifying the degree of anti-windup protection to be provided by the anti-windup unit 202. Using these inputs, the anti-windup unit 202 may calculate the actual actuator setpoint changes. The anti-windup unit 202 then provides output values $C_{OUT}$(k), which represent the actual actuator setpoint changes.

In some embodiments, the code implementing the break recovery control module 200 and the anti-windup unit 202 may be readable and modular. Also, the functionality of these units may be consistent with the other units or modules in the controller 104. In addition, user interface displays associated with these units (such as the one shown in FIG. 5) may be consistent with other displays associated with the controller 104.

Each of the components shown in FIG. 2 could be implemented using any suitable hardware, software, firmware, or combination thereof. Each of the components could, for example, represent software components executed on a processor in the controller.

Although FIG. 2 illustrates one example of a controller 104 in a process control system, various changes may be made to FIG. 2. For example, the controller 104 could receive and operate using any other or additional input. Also, the controller 104 could include any number of control units.

Figure 3:
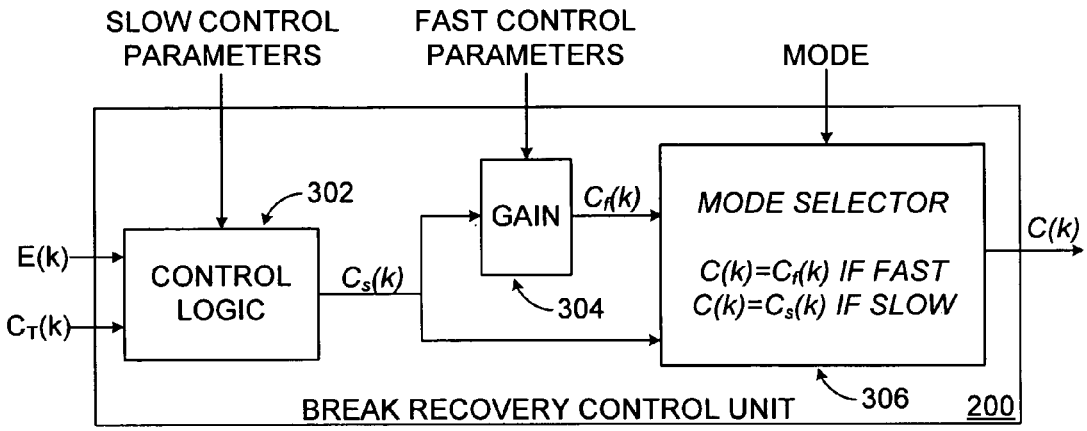
FIG. 3 illustrates an example break recovery control unit in a controller of a process control system in accordance with this disclosure.

FIG. 3 illustrates an example break recovery control module 200 in a controller of a process control system in accordance with this disclosure. The break recovery control module 200 shown in FIG. 3 is for illustration only. Other embodiments of the break recovery control module 200 could be used without departing from the scope of this disclosure. Also, for ease of explanation, the break recovery control module 200 is described as operating in the controller 104 of the process control system 100 in FIG. 1. The break recovery control module 200 could be used in any other device and in any other system.

In this example, the break recovery control module 200 includes a control logic unit 302, a gain unit 304, and a mode selector 306. Each of the components shown in FIG. 3 could be implemented using any suitable hardware, software, firmware, or combination thereof.

The control logic unit 302 generally implements the logic used to select setpoints for one or more actuators. The control logic unit 302 could, for example, represent the same logic used in an FVDTAlpha controller. Setpoint changes output by the control logic unit 302 are denoted $C_S(k)$ and are said to represent "slow" setpoint changes, or setpoint changes output when the break recovery control module 200 is operating in the slow or steady-state mode.

The gain unit 304 processes the "slow" setpoint changes output by the control logic unit 302 and increases the rate of change, thereby leading to the creation of "fast" setpoint changes denoted $C_F(k)$ that alter the operation of one or more actuators more quickly. In some embodiments, the gain provided by the gain unit 304 could represent a fixed gain. In particular embodiments, the gain provided by the gain unit 304 is based on the ratio of an "alpha gain" tuning parameter for the fast mode to an "alpha gain" tuning parameter for the slow mode.

The mode selector 306 controls whether the "slow" or "fast" setpoint changes are output by the break recovery control module 200. For example, upon rethreading of a paper sheet 108 after a sheet break, the break recovery control module 200 operates in the fast mode, and the mode selector 306 outputs the "fast" setpoint changes. Once the measurement profile has settled to a certain level or a specified amount of time has elapsed, the break recovery control module 200 switches to the slow mode, and the mode selector 306 outputs the "slow" setpoint changes.

Depending on the implementation, the break recovery control module 200 could receive the following inputs: the current position or setpoint of each actuator, the overall process time delay observed from a change in an actuator setpoint, the average time between consecutive executions of the control law (may take into account the average measurement and the number of measurements between control actions), and the process gain and time constant for both positive and negative errors for each actuator. The break recovery control module 200 could also receive as input α_fast tuning factors and α_slow tuning factors (for both positive and negative errors for each actuator). In addition, a mode input determines whether the "fast" or "slow" setpoint changes should be output. The break recovery control module 200 could then output the desired setpoint changes for each actuator.

In particular embodiments, the control logic unit 302 may receive the following as tuning parameter inputs:

E(k) (the current error profile);

$C_T(k)$ (the setpoint change history);

$K_c^S=1-e^{-T_s/\alpha_s}$ (the "alpha gain" tuning parameter for slow controller mode); and

- $K_E^S = \frac{K_C^S}{K_P(1-\rho)}$ (the "error gain" tuning parameter for slow controller mode).

The output of the control logic unit 302 could be defined as:

- $$C_S(k) = -K_C^S\left[\sum_{j=1}^{d} C_T(k-j) - \left(d - \frac{T_D}{T_S}\right)C_T(k-d)\right] + K_E^S[E(k) - \rho E(k-1)].$$

The gain unit 304 may receive as a tuning parameter input $K_c^f=1-e^{-T_s/\alpha_f}$ (the "alpha gain" tuning parameter for fast controller mode). The output of the gain unit 304 could be defined as:

- $$C_F(k) = \frac{K_C^F}{K_C^S} C_S(k).$$

Here, $\alpha_s$ represents the desired closed-loop time constant (in seconds) for slow controller mode, and $\alpha_f$ represents the desired closed-loop time constant (in seconds) for fast controller mode. Also, $\rho=e^{-T_s/\tau}$ represents a discrete time constant computed from a continuous time constant τ. The outputs of the various units in FIG. 3 include $C_f(k)$ (the desired setpoint change in fast controller mode), $C_s(k)$ (the desired setpoint change in slow controller mode), and C(k) (the selected setpoint change).

Although FIG. 3 illustrates one example of a break recovery control module 200 in a controller of a process control system, various changes may be made to FIG. 3. For example, the break recovery control module 200 could support more than two modes of operation.

Figure 4:
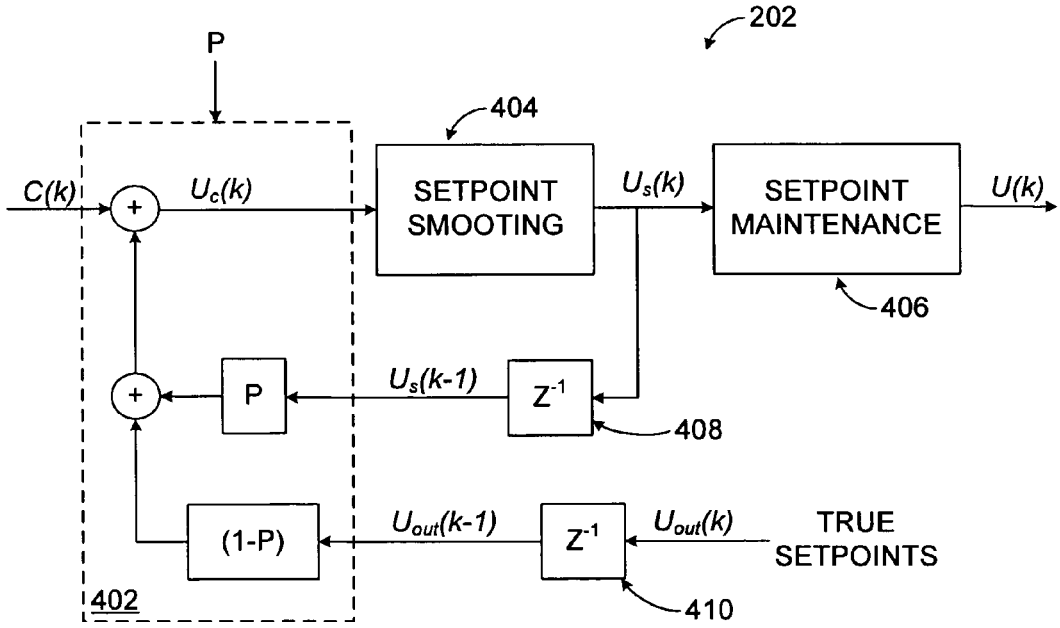
FIG. 4 illustrates an example anti-windup unit in a controller of a process control system in accordance with this disclosure.

FIG. 4 illustrates an example anti-windup unit 202 in a controller of a process control system in accordance with this disclosure. The anti-windup unit 202 shown in FIG. 4 is for illustration only. Other embodiments of the anti-windup unit 202 could be used without departing from the scope of this disclosure. Also, for ease of explanation, the anti-windup unit 202 is described as operating in the controller 104 of the process control system 100 in FIG. 1. The anti-windup unit 202 could be used in any other device and in any other system.

In this example, the anti-windup unit 202 includes an anti-windup protection module 402, a setpoint smoothing module 404, a setpoint maintenance module 406, and two time delay modules 408-410. In general, the anti-windup protection module 402 receives the values of C(k) from the break recovery control module 200. The anti-windup protection module 402 then processes the values of C(k) to produce output values $U_C(k)$. For example, the anti-windup protection module 402 may produce the output values $U_C(k)$ by modifying the values of C(k) based on prior outputs of the setpoint smoothing module 404 and the setpoint maintenance module 406. As a particular example, the anti-windup protection module 402 could generate the output values $U_C(k)$ using the function:

$$U_C(k)=p\cdot U_S(k-1)+(1-p)\cdot U_{OUT}(k-1)+C(k).$$

Here, C(k) represents a setpoint array from the break recovery control module 200, $U_s(k)$ represents the setpoint array after setpoint smoothing and before setpoint maintenance, and $U_{OUT}(k)$ represents the current "true" setpoint array or position array if position feedback is available. Also, p represents a constant parameter, where $0 \leqq p \leqq 1$. The value of p may represent a user-specified parameter that allows the user to manipulate the degree of anti-windup protection provided by the anti-windup unit 202. In this example, p is a discrete time pole of an anti-windup characteristic polynomial. When p equals zero, this may be equivalent to the standard implementation of anti-windup. When p equals one, this approximates the theoretical setpoint, where the theoretical setpoint is the setpoint in the absence of constraints. If setpoint smoothing is disabled, then this is equivalent to the theoretical setpoint.

This implementation of anti-windup does not require explicit knowledge of various constraints (such as $U_{MAX}$, $U_{MIN}$, etc.) commonly used in anti-windup schemes. This implementation may implicitly contain this knowledge from the weighted difference between the post-smoothing profile $U_S(k)$ and the current setpoint profile $U_{OUT}(k)$. In this way, this implementation also takes into account constraints such as bend limits, which are not accounted for in either standard anti-windup or in the use of theoretical setpoints.

The setpoint smoothing module 404 generally performs functions for smoothing the setpoint values to be provided to an actuator. This may help to reduce the effects caused by transients in the $U_C(k)$ signal. The smoothed setpoint values are denoted $U_S(k)$. The setpoint maintenance module 406 processes the $U_S(k)$ signal to minimize the risk of the actuator setpoints violating physical bend limit constraints. The delay modules 408-410 ensure that delayed outputs from the setpoint smoothing module 404 and the setpoint maintenance module 406 are provided to the anti-windup protection module 402.

Each of the components shown in FIG. 4 could be implemented using any suitable hardware, software, firmware, or combination thereof.

Although FIG. 4 illustrates an example anti-windup unit 202 in a controller of a process control system, various changes may be made to FIG. 4. For example, the anti-windup protection module 202 could operate in any other suitable manner for providing a user-defined level of anti-windup protection.

Figure 5:
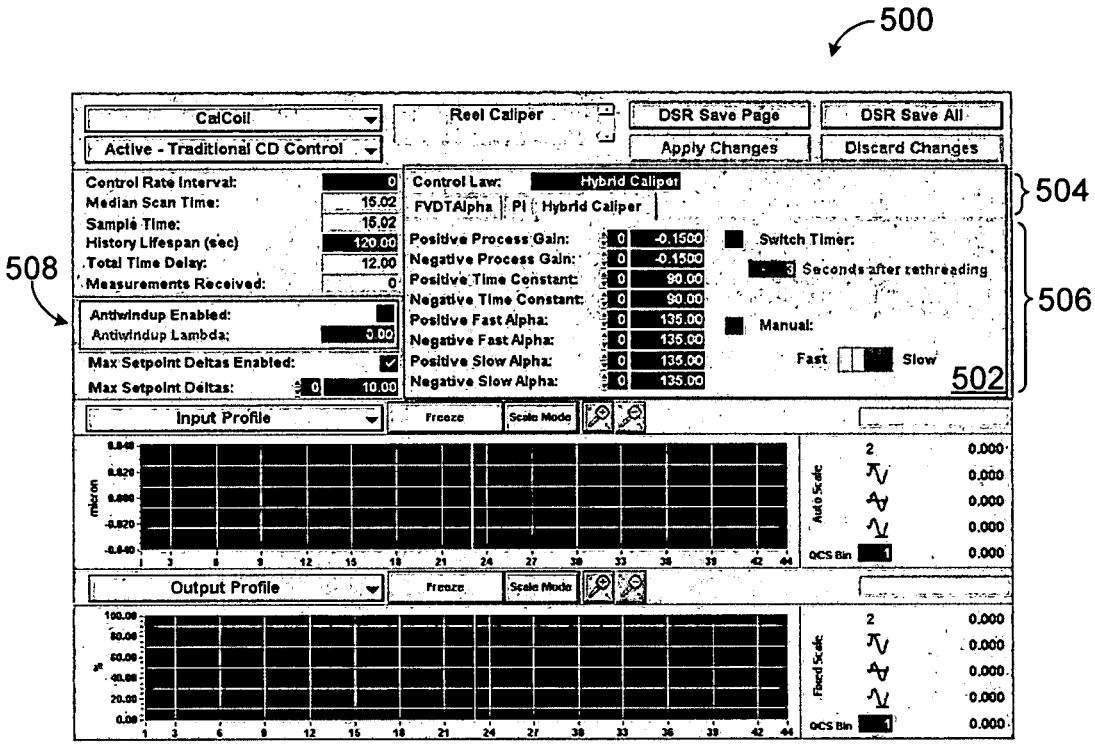
FIG. 5 illustrates an example graphical user interface supporting break recovery and other functions in a process control system in accordance with this disclosure.

FIG. 5 illustrates an example graphical user interface 500 supporting break recovery and other functions in a process control system in accordance with this disclosure. In particular, the graphical user interface 500 may be used to configure various units and modules in the controller 104. The graphical user interface 500 shown in FIG. 5 is for illustration only. Other embodiments of the graphical user interface 500 could be used without departing from the scope of this disclosure. Also, for ease of explanation, the graphical user interface 500 is described as operating in the controller 104 in the process control system 100 of FIG. 1. The graphical user interface 500 could be used in any other device and in any other system.

The example graphical user interface 500 can be used to configure (among other things) the break recovery control module 200 and the anti-windup unit 202. For example, the graphical user interface 500 includes a configuration area 502, which allows the user to configure the operation of (among other things) the break recovery control module 200. In this example, the configuration area 502 includes a control law selection area 504, which is formed from multiple tabs and allows the user to select different control laws for configuration. The configuration area 502 also includes a control law configuration area 506, which allows the user to configure the selected control law.

When the break recovery control module 200 is selected in the control law selection area 504 (by selecting the "Hybrid Caliper" tab), the information shown in FIG. 5 may be presented to the user in the control law configuration area 506. The control law configuration area 506 here allows the user to configure tuning parameters and to select the mode of switching from fast control to slow control (automatically or manually). For automatic switching, the user can configure a switch timer specifying the minimum amount of time to pass before switching from fast control to slow control mode. For manual switching, a switch is provided that can be selected by the user.

The graphical user interface 500 also includes an anti-windup configuration area 508. The anti-windup configuration area 508 allows the user to enable or disable the anti-windup unit 202. If enabled, the user can also specify the amount of anti-windup protection provided by the anti-windup unit 202 by configuring a tuning parameter (denoted "Lambda").

Although FIG. 5 illustrates one example of a graphical user interface 500 supporting break recovery and other functions in a process control system, various changes may be made to FIG. 5. For example, the arrangement and content of the graphical user interface 500 is for illustration only. Also, the various parameters and other contents of the graphical user interface 500 are examples only. Any other or additional parameters could be configured by a user using the graphical user interface 500.

Figure 6:
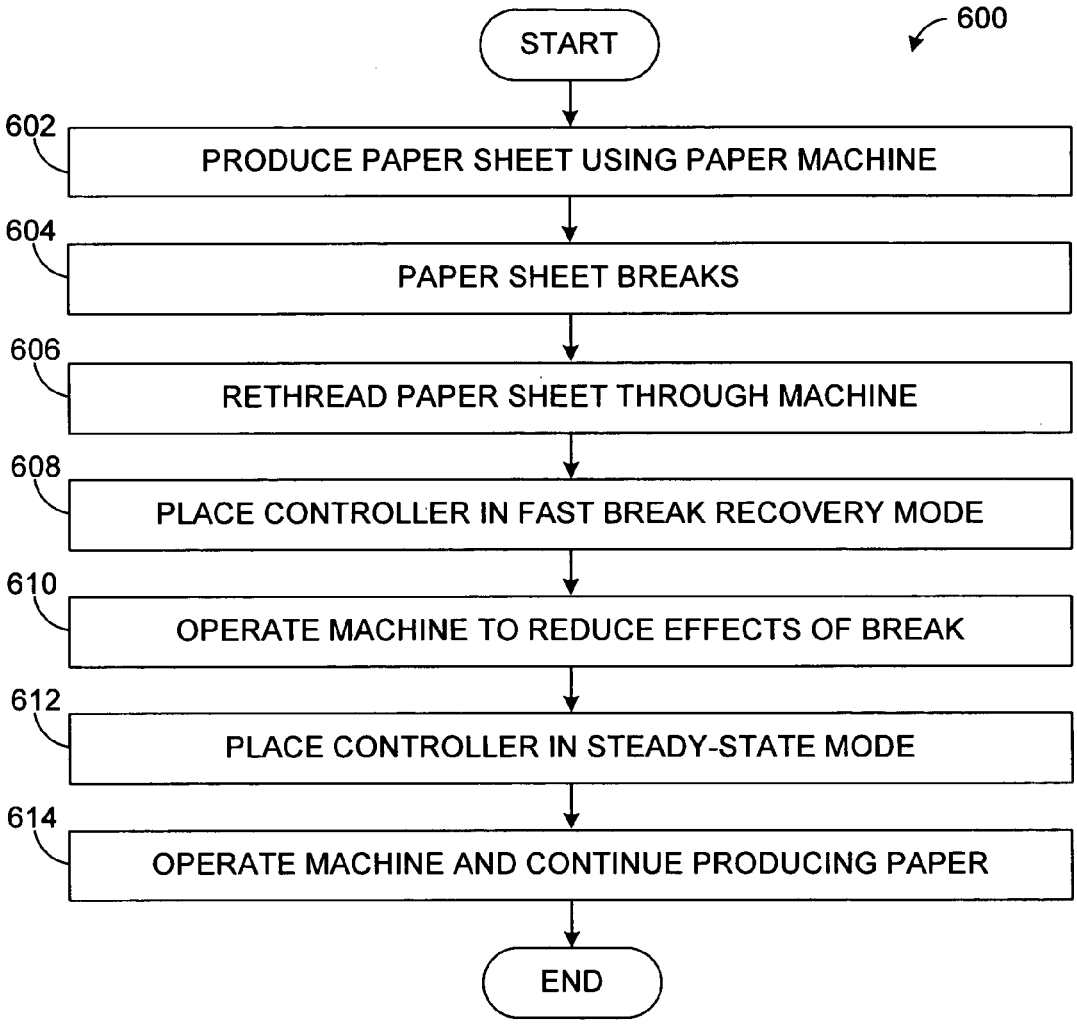
FIG. 6 illustrates an example method for break recovery in a paper machine in accordance with this disclosure.

FIG. 6 illustrates an example method 600 for break recovery in a paper machine in accordance with this disclosure. For ease of explanation, the method 600 in FIG. 6 is described with respect to the controller 104 operating in the system 100 of FIG. 1. The method 600 could be used by any other suitable device and in any other suitable system.

A paper sheet 108 is produced using a paper machine 102 at step 602. This may include, for example, the controller 104 controlling the actuators in the paper machine 102 while in a steady-state or slow mode of operation. The paper sheet 108 then breaks at step 604, and the paper sheet 108 is rethreaded through the paper machine 102 at step 606.

At this point, the controller 104 is placed in a fast mode of operation at step 608. This could happen automatically, such as when the controller 104 detects the sheet break and then detects resumption of the paper machine's operation. This could also happen manually, such as when a user selects an option to place the controller 104 in the fast mode of operation. Operation of the paper machine 102 resumes, and the controller 104 operates the paper machine 102 so as to quickly reduce or eliminate the effects of the sheet break at step 610. This may include, for example, the controller 104 making more rapid or radical setpoint changes to the actuators in the paper machine 102.

Eventually, the effects of the sheet break are reduced (such as when the caliper profile is within a threshold of a desired profile) or a specified period of time elapses, and the controller enters the steady-state or slow mode of operation at step 612. The controller 104 may then continue to operate the paper machine 102 to produce the paper sheet 108 while in the slow mode of operation at step 614.

In this way, the operation of the controller 104 may change to account for the break of the paper sheet 108. The controller 104 can make more radical or rapid setpoint changes immediately after the paper sheet 108 is rethreaded in the paper machine 102. The controller 104 can make fewer or smaller setpoint changes after the effects of the sheet break have been reduced.

Although FIG. 6 illustrates one example of a method 600 for break recovery in a paper machine, various changes may be made to FIG. 6. For example, while shown as a series of steps, various steps shown in FIG. 6 could overlap or occur in parallel.

In some embodiments, various functions described above are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory.

It may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. The term "controller" means any device, system, or part thereof that controls at least one operation. A controller may be implemented in hardware, firmware, software, or some combination of at least two of the same. The functionality associated with any particular controller may be centralized or distributed, whether locally or remotely.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method, comprising:

determining one or more setpoint changes for one or more actuators in a process control system, wherein determining the one or more setpoint changes comprises:

making larger or more frequent setpoint changes when operating in a first mode; and making smaller or less frequent setpoint changes when operating in a second mode; and outputting the one or more setpoint changes to the one or more actuators;

wherein making the smaller or less frequent setpoint changes comprises determining the smaller or less frequent setpoint changes using control logic; and wherein making the larger or more frequent setpoint changes comprises applying a gain to the smaller or less frequent setpoint changes determined by the control logic.

2. The method of claim 1, wherein the process control system comprises a paper machine operable to produce a paper sheet; and further comprising entering the first mode after the paper sheet has broken and been rethreaded through the paper machine.

3. The method of claim 2, further comprising entering the second mode after a specified amount of time has elapsed since entering the first mode.

4. The method of claim 2, wherein the one or more actuators comprise one or more induction heating actuators operable to adjust a caliper profile of the paper sheet; and further comprising entering the second mode after the first mode has been entered and the caliper profile of the paper sheet is within a specified threshold of a desired caliper profile.

5. The method of claim 1, further comprising:

providing a graphical user interface to a user; and receiving from the user, using the graphical user interface, at least one of:

information specifying whether a transition from the first mode to the second mode occurs manually or automatically;

information specifying a length of time required before automatically switching from the first mode to the second mode; and information indicating when the transition from the first mode to the second mode manually occurs.

6. The method of claim 1, wherein outputting the one or more setpoint changes comprises processing the one or more setpoint changes to provide anti-windup protection and outputting the one or more processed setpoint changes to the one or more actuators.

7. The method of claim 6, further comprising:

receiving information from a user specifying a level of anti-windup protection.

8. An apparatus, comprising:

a control module operable to determine one or more setpoint changes for one or more actuators in a process control system, the control module operable to determine the one or more setpoint changes by:

making larger or more frequent setpoint changes when operating in a first mode; and making smaller or less frequent setpoint changes when operating in a second mode; and an interface operable to output the one or more setpoint changes to the one or more actuators;

wherein the control module comprises:

control logic operable to determine the smaller or less frequent setpoint changes; and a gain unit operable to apply again to the smaller or less frequent setpoint changes to produce the larger or more frequent setpoint changes.

9. The apparatus of claim 8, wherein:

the process control system comprises a paper machine operable to produce a paper sheet; and the control module is further operable to enter the first mode after the paper sheet has broken and been rethreaded through the paper machine.

10. The apparatus of claim 9, wherein the control module is further operable to enter the second mode after a specified amount of time has elapsed since entering the first mode.

11. The apparatus of claim 9, wherein:

the one or more actuators comprise one or more induction heating actuators operable to adjust a caliper profile of the paper sheet; and the control module is further operable to enter the second mode after the first mode has been entered and the caliper profile of the paper sheet is within a specified threshold of a desired caliper profile.

12. The apparatus of claim 8, further comprising a graphical user interface operable to receive from a user at least one of:

information specifying whether a transition from the first mode to the second mode occurs manually or automatically;

information specifying a length of time required before automatically switching from the first mode to the second mode; and information indicating when the transition from the first mode to the second mode manually occurs.

13. The apparatus of claim 8, further comprising an anti-windup unit operable to process the one or more setpoint changes to provide anti-windup protection; and wherein the interface is operable to output the one or more processed setpoint changes to the one or more actuators.

14. The apparatus of claim 13, wherein a level of anti-windup protection is specified by a user.

15. The apparatus of claim 8, wherein the control module is executed by a controller in the process control system.

16. A computer readable medium embodying a computer program, the computer program comprising:

computer readable program code for determining one or more setpoint changes for one or more actuators in a process control system, wherein the computer readable program code for determining the one or more setpoint changes comprises:

computer readable program code for making larger or more frequent setpoint changes when operating in a first mode; and computer readable program code for making smaller or less frequent setpoint changes when operating in a second mode; and computer readable program code for outputting the one or more setpoint changes to the one or more actuators;

wherein the computer readable program code for making the smaller or less frequent setpoint changes implements control logic for determining the smaller or less frequent setpoint changes; and wherein the computer readable program code for making the larger or more frequent setpoint changes comprises computer readable program code for applying a gain to the smaller or less frequent setpoint changes.

17. The computer readable medium of claim 16, wherein the process control system comprises a paper machine operable to produce a paper sheet; and further comprising computer readable program code for entering the first mode after the paper sheet has broken and been rethreaded through the paper machine.

18. The computer readable medium of claim 17, further comprising computer readable program code for entering the second mode after a specified amount of time has elapsed since entering the first mode.

19. The computer readable medium of claim 17, wherein the one or more actuators comprise one or more induction heating actuators operable to adjust a caliper profile of the paper sheet; and further comprising computer readable program code for entering the second mode after the first mode has been entered and the caliper profile of the paper sheet is within a specified threshold of a desired caliper profile.

20. A system, comprising:

a paper machine operable to produce a paper sheet, the paper machine comprising a plurality of actuators; and a controller operable to determine one or more setpoint changes for one or more of the actuators, the controller operable to determine the one or more setpoint changes by:

making larger or more frequent setpoint changes when operating in a first mode; and making smaller or less frequent setpoint changes when operating in a second mode;

wherein the controller:

control logic operable to determine the smaller or less frequent setpoint changes; and a gain unit operable to apply a gain to the smaller or less frequent setpoint changes to produce the larger or more frequent setpoint changes.

* * * * *